US012593908B2

(12) United States Patent
Wagner, II

(10) Patent No.: US 12,593,908 B2
(45) Date of Patent: Apr. 7, 2026

(54) CELL PHONE ARMBAND WITH POLYPROPYLENE OR LOW FRICTION PANELS INSIDE POCKET

(71) Applicant: Tune Belt, Inc., Cincinnati, OH (US)

(72) Inventor: Richard S. Wagner, II, Loveland, OH (US)

(73) Assignee: TUNE BELT, INC., Cincinnati, OH (US)

( * ) Notice: Subject to any disclaimer, the term of this patent is extended or adjusted under 35 U.S.C. 154(b) by 422 days.

(21) Appl. No.: 18/192,447

(22) Filed: Mar. 29, 2023

(65) Prior Publication Data

US 2023/0380579 A1 Nov. 30, 2023

Related U.S. Application Data

(60) Provisional application No. 63/327,936, filed on Apr. 6, 2022.

(51) Int. Cl.
*A45F 5/00* (2006.01)

(52) U.S. Cl.
CPC ..... *A45F 5/00* (2013.01); *A45F 2005/008* (2013.01); *A45F 5/1516* (2025.01)

(58) Field of Classification Search
CPC ..... A41D 27/20; A41D 27/205; A45C 1/04; A45C 1/06; A45C 11/00; A45C 11/002; A45C 11/182; A45C 13/30; A45F 2005/008; A45F 2200/0516; A45F 3/166; A45F 5/00; A45F 5/1516; Y10S 224/93
USPC ..... 224/222
See application file for complete search history.

(56) References Cited

U.S. PATENT DOCUMENTS 1,222,735 A * 4/1917 Coleman ..... A41D 27/20 2/251
1,883,461 A * 10/1932 Baccaro ..... A41D 27/20 2/247
1,920,401 A 8/1933 Kahn
2,711,202 A 6/1955 Freedman
4,061,256 A 12/1977 Beer et al.
4,135,653 A 1/1979 Sieloff
4,432,477 A 2/1984 Haidt et al.
4,500,019 A 2/1985 Curley, Jr.
4,509,667 A 4/1985 Meldrum
4,526,298 A 7/1985 Boxer et al.
4,569,465 A * 2/1986 O'Farrell ..... A45C 1/04 224/660
4,845,784 A * 7/1989 Shirinian ..... A41D 27/20 2/253
4,913,326 A 4/1990 Echelson
4,966,322 A 10/1990 Zagorski et al.
4,974,762 A 12/1990 Boretsky et al.
5,105,309 A 4/1992 Baravaglio et al.
5,170,917 A 12/1992 Tourigny
(Continued)

*Primary Examiner* — Nathan J Newhouse
*Assistant Examiner* — Matthew T Theis
(74) *Attorney, Agent, or Firm* — Sand, Sebolt & Wernow Co., LPA

(57) ABSTRACT

A wearable armband having a secure pocket defined therein for holding a user's personal cellphone or similar device. The armband may incorporate additional liner panels allowing for fast and efficient removal and insertion of the user's device without removing the armband while simultaneously providing a secure hold to prevent movement or unwanted removal of the device from the armband.

20 Claims, 13 Drawing Sheets

(56) References Cited

U.S. PATENT DOCUMENTS 5,351,868 A * 10/1994 Beletsky ..... A45F 5/02 224/667
5,758,671 A 6/1998 Thim
5,794,769 A 8/1998 Tomlinson et al.
5,836,488 A 11/1998 Priestley
5,967,870 A 10/1999 Bertoncelli et al.
6,062,700 A 5/2000 Price
6,085,449 A 7/2000 Tsui
6,618,906 B2 9/2003 Ciesiun
6,629,628 B1 10/2003 Canepari et al.
6,641,015 B2 11/2003 Huggins
6,728,556 B1 4/2004 Whitley
7,364,491 B2 4/2008 Updyke
7,410,083 B2 8/2008 Reid
7,493,663 B2 2/2009 Gorsen
D594,659 S * 6/2009 Lown ..... D3/299
7,681,855 B1 3/2010 Cashman et al.
7,712,479 B2 5/2010 Sundarrao
7,819,293 B1 10/2010 O'Connell
7,848,512 B2 12/2010 Eldracher
8,016,107 B2 9/2011 Emsky
8,302,769 B2 11/2012 Justiss
8,333,353 B1 12/2012 Silverman et al.
8,397,962 B1 3/2013 O'Connell
8,474,669 B2 7/2013 Rohrbach et al.
8,516,621 B2 8/2013 Woolery
8,608,036 B2 12/2013 Mori et al.
8,714,421 B2 5/2014 Norling
8,752,740 B2 6/2014 Morgan et al.
8,800,829 B2 8/2014 Bergenudd et al.
8,852,095 B2 10/2014 Schlottau et al.
8,857,683 B2 10/2014 Cameron et al.
8,915,361 B2 12/2014 Rayner
RE45,402 E 3/2015 Taylor
8,973,795 B2 3/2015 Chiu, Jr. et al.
8,978,943 B2 3/2015 Rohrbach et al.
8,978,944 B2 3/2015 Mori et al.
9,055,795 B2 6/2015 Larkin
9,078,478 B2 7/2015 Ross, Jr.
9,084,468 B2 7/2015 Conwell
9,101,323 B2 8/2015 Einarsson
9,107,299 B2 8/2015 Rayner
9,179,562 B2 11/2015 Rayner
9,210,992 B2 12/2015 Debeers
9,229,494 B2 1/2016 Rayner
9,271,532 B2 3/2016 Cole
9,271,561 B2 3/2016 Chang
9,277,804 B1 3/2016 Gennodie
9,317,076 B2 4/2016 Rayner
9,340,341 B2 5/2016 Farrell
9,345,310 B2 5/2016 Chiu, Jr. et al.
9,351,551 B2 5/2016 Morgan et al.
9,380,723 B2 6/2016 Rayner
9,439,314 B2 9/2016 Rayner et al.
9,445,659 B1 9/2016 Nix et al.
9,450,634 B2 9/2016 Rayner
9,510,655 B2 12/2016 Stratton
9,516,940 B2 12/2016 Lowry
9,521,868 B2 12/2016 Cobbett et al.
9,532,639 B2 1/2017 Kimble
9,532,893 B2 1/2017 Beers et al.
9,548,785 B2 1/2017 Rayner
9,549,598 B2 1/2017 Rayner et al.
9,578,903 B2 2/2017 Cobbett et al.
9,582,072 B2 2/2017 Connor
9,615,650 B2 4/2017 Soriano et al.
9,622,557 B1 4/2017 Beavers et al.
9,657,867 B2 5/2017 Zurawski
9,697,657 B2 7/2017 Anderson et al.
9,709,971 B2 7/2017 Ellis
9,712,202 B2 7/2017 Bao
9,717,311 B2 8/2017 Odashima et al.
9,743,745 B2 8/2017 Duddy
9,756,928 B2 9/2017 Cameron et al.
9,763,510 B1 9/2017 Miner
9,781,984 B2 10/2017 Baranski et al.
9,854,861 B2 1/2018 Covelli et al.
9,877,523 B2 1/2018 Ellis
9,894,983 B2 2/2018 Hernandez et al.
9,900,041 B2 2/2018 Rayner
9,955,762 B2 5/2018 Rayner
9,962,111 B2 5/2018 Balakrishnan et al.
9,986,814 B1 6/2018 Nix et al.
10,002,635 B2 6/2018 Mack et al.
10,012,969 B2 7/2018 Ellis
10,018,300 B1 7/2018 De Michele
10,061,350 B2 8/2018 Magi
10,064,458 B2 9/2018 Griffin, II et al.
10,085,517 B2 10/2018 Beers et al.
10,105,097 B2 10/2018 Markel
10,149,521 B2 12/2018 Baranski et al.
10,164,676 B2 12/2018 Zerfus
10,172,396 B2 1/2019 Ellis
10,182,937 B2 1/2019 Smith et al.
10,188,186 B2 1/2019 Norman
10,194,702 B2 2/2019 Cobbett et al.
10,213,647 B2 2/2019 Balakrishnan et al.
10,226,082 B2 3/2019 Ellis
10,227,721 B2 3/2019 Hatanaka et al.
10,234,934 B2 3/2019 Connor
10,271,587 B2 4/2019 Cobbett et al.
10,285,523 B2 5/2019 Pugsley
10,293,239 B2 5/2019 Balakrishnan et al.
10,299,554 B2 5/2019 Rayner
10,321,873 B2 6/2019 Connor
10,325,472 B1 6/2019 Harsdorff et al.
10,334,893 B2 7/2019 Cobbett et al.
10,334,938 B2 7/2019 Nix et al.
10,342,482 B1 7/2019 Lisy et al.
10,362,813 B2 7/2019 Cobbett et al.
10,362,855 B2 7/2019 Whang et al.
10,384,113 B2 8/2019 Balakrishnan et al.
10,398,200 B2 9/2019 Baranski et al.
10,413,020 B2 9/2019 Beers et al.
10,455,867 B2 10/2019 Donohoe et al.
10,470,973 B2 11/2019 Machado Pires
10,504,310 B2 12/2019 Anderson et al.
10,525,322 B2 1/2020 Balakrishnan et al.
10,548,380 B2 2/2020 Rayner et al.
10,559,184 B2 2/2020 Harsdorff et al.
10,568,369 B2 2/2020 Ellis
10,601,965 B2 3/2020 Sirichai
10,617,198 B1 4/2020 De Michele
10,621,956 B2 4/2020 Inagaki et al.
10,660,427 B2 5/2020 Nix et al.
10,687,562 B2 6/2020 Donohoe et al.
10,716,377 B2 7/2020 Rayner
10,729,964 B2 8/2020 Balakrishnan et al.
10,758,017 B2 9/2020 Norman
10,758,182 B2 9/2020 Wang et al.
10,784,915 B2 9/2020 Montgomery
10,799,660 B2 10/2020 Klurfeld
10,813,388 B2 10/2020 Cobbett et al.
10,820,652 B2 11/2020 Schlam et al.
10,827,809 B2 11/2020 Skahan
10,874,346 B1 12/2020 Lisy et al.
10,892,625 B1 1/2021 Franklin et al.
10,925,327 B2 2/2021 Cobbett et al.
10,932,501 B1 3/2021 Powell
10,945,502 B2 3/2021 Herrmann
10,951,968 B2 3/2021 Honeycutt
10,953,248 B2 3/2021 Yu et al.
10,973,310 B2 4/2021 Vlassis et al.
10,993,490 B2 5/2021 Markel
11,037,424 B2 6/2021 Harsdorff et al.
11,043,242 B2 6/2021 Mack et al.
11,071,364 B1 7/2021 Fowler
11,076,969 B2 8/2021 Meikle
11,120,909 B2 9/2021 Ellis
11,150,694 B2 10/2021 Markovsky et al.
11,166,540 B2 11/2021 Nix et al.
11,177,037 B2 11/2021 Sanders et al.
11,177,038 B2 11/2021 Sanders et al.
2002/0100108 A1 8/2002 Stuart

(56) References Cited

U.S. PATENT DOCUMENTS

2002/0177495 A1 11/2002 Ciesiun
2003/0022737 A1 1/2003 Ciesiun
2003/0052143 A1 3/2003 Devine
2003/0230606 A1 12/2003 Devinie
2004/0031120 A1 2/2004 Cherian
2004/0067786 A1 4/2004 Sanfilippo
2004/0144814 A1 7/2004 Katsanevas
2004/0144815 A1 7/2004 Reid
2005/0056201 A1 3/2005 Jones et al.
2005/0082323 A1 4/2005 O'Hair
2005/0145657 A1 7/2005 Norberg
2005/0207698 A1 9/2005 Weiser
2005/0220529 A1 10/2005 Katsanevas
2005/0250974 A1 11/2005 Bailey et al.
2006/0011679 A1 1/2006 Santiago
2006/0016841 A1 1/2006 Shurm
2006/0076250 A1 4/2006 Kwasney
2006/0076375 A1 4/2006 Bhakta
2006/0076376 A1 4/2006 Kemery et al.
2006/0124675 A1 6/2006 Calicott
2006/0261107 A1 11/2006 Daniels
2006/0266776 A1 11/2006 Plakke
2007/0080077 A1 4/2007 Thormahlen
2007/0215663 A1 9/2007 Chongson et al.
2007/0262112 A1 11/2007 Butler et al.
2007/0286667 A1 12/2007 Katsanevas
2008/0011794 A1 1/2008 Daniel
2008/0047990 A1 2/2008 Morgan et al.
2008/0142129 A1 6/2008 Reasner et al.
2009/0014105 A1 1/2009 Shattuck
2009/0039122 A1 2/2009 Antonioni
2009/0265971 A1 10/2009 Cook
2009/0272774 A1 11/2009 Craig
2010/0155438 A1 6/2010 Halpin
2011/0000945 A1 1/2011 Mongan et al.
2011/0031290 A1 2/2011 Remo
2011/0108589 A1 5/2011 Kim
2011/0240493 A1 10/2011 Adams et al.
2011/0290833 A1 12/2011 Koerner
2012/0010593 A1 1/2012 Powell
2012/0025945 A1 2/2012 Yazadi et al.
2012/0055963 A1 3/2012 Phair
2012/0063066 A1 3/2012 Floit
2012/0080462 A1 4/2012 Hajarian
2012/0104058 A1* 5/2012 Hernandez ..... A45F 5/021 224/660
2012/0145755 A1 6/2012 Kahn
2012/0152990 A1 6/2012 Kulas
2012/0255092 A1 10/2012 Wilson, II et al.
2012/0312851 A1 12/2012 Rico
2013/0001263 A1 1/2013 Kai
2013/0020359 A1 1/2013 Green
2013/0098955 A1 4/2013 Lamey et al.
2013/0122974 A1 5/2013 Haramein
2013/0146623 A1 6/2013 Murray
2013/0326790 A1 12/2013 Cauwels et al.
2014/0263495 A1 9/2014 Koch
2015/0136821 A1 5/2015 Sorenson
2015/0182008 A1 7/2015 Kattouf, II
2015/0201723 A1 7/2015 Rayner et al.
2015/0320190 A1 11/2015 Gaudet et al.
2016/0081462 A1 3/2016 Debeers
2016/0106201 A1 4/2016 Taylor
2016/0120733 A1 5/2016 Ishikawa et al.
2016/0135743 A1 5/2016 Cobbett et al.
2016/0140867 A1 5/2016 Aragones et al.
2016/0143424 A1* 5/2016 Stephens ..... A45F 3/005 224/676
2016/0192516 A1 6/2016 Thompson
2016/0309865 A1 10/2016 Chiang
2016/0324303 A1 11/2016 Mudge
2016/0353865 A1 12/2016 Sims
2017/0235338 A1 8/2017 Wong et al.
2017/0266501 A1 9/2017 Sanders et al.
2017/0332770 A1 11/2017 Miner
2017/0340095 A1 11/2017 Cameron et al.
2018/0029304 A1 2/2018 Pauli et al.
2018/0063306 A1 3/2018 Scannell, Jr.
2018/0137749 A1 5/2018 Varga
2018/0199641 A1 7/2018 Raso
2018/0206566 A1 7/2018 Ramirez et al.
2018/0255850 A1 9/2018 Sullum
2018/0295896 A1 10/2018 Donohoe et al.
2019/0048521 A1 2/2019 Meemaduma et al.
2019/0060099 A1 2/2019 Ciocarlic et al.
2019/0142087 A1 5/2019 Kelly
2019/0159537 A1* 5/2019 Blythe ..... A41D 27/205
2019/0208879 A1 7/2019 Gawley
2019/0239605 A1 8/2019 Cooke et al.
2019/0322441 A1* 10/2019 Rosenberg ..... A45C 13/1069
2019/0328163 A1 10/2019 Grytsenko
2020/0029636 A1 1/2020 Kelly
2020/0121203 A1 4/2020 Ellis et al.
2020/0178628 A1 6/2020 Merrill et al.
2020/0275764 A1 9/2020 King
2020/0315267 A1 10/2020 Donohoe et al.
2021/0030091 A1 2/2021 Wasserman
2021/0108660 A1 4/2021 Russell-Clarke et al.
2021/0112897 A1 4/2021 Farmer
2021/0127816 A1 5/2021 Sirichai
2021/0137411 A1 5/2021 Hanna
2021/0177081 A1 6/2021 Schlam et al.
2021/0212398 A1 7/2021 Markel
2021/0219624 A1 7/2021 Miller
2021/0289856 A1 9/2021 Kishineff
2021/0304580 A1 9/2021 Harsdorff et al.
2021/0375453 A1 12/2021 Ellis

* cited by examiner

CELL PHONE ARMBAND WITH POLYPROPYLENE OR LOW FRICTION PANELS INSIDE POCKET

CROSS-REFERENCE TO RELATED APPLICATIONS

This application claims the benefit of U.S. Provisional Application Ser. No. 63/327,936 filed Apr. 6, 2022, the disclosure of which is incorporated herein by reference in its entirety.

TECHNICAL FIELD

The present disclosure relates generally to the field of exercise equipment and accessories.

BACKGROUND

Many current exercise armbands exist for use in securing a user's personal cellular telephone or other similar device while engaging in exercise or exercise-related activities, such as walking, running, jogging, biking, hiking, weight-lifting, or the like. These and other similar armbands may also be used for other activities, such as yard work, that require the use of both hands but still allow for use of a personal device. These current products are configured to hold a multitude of devices having various sizes and/or shapes; however, many of the current products are designed solely for securely holding devices and do not generally allow universal easy access for removal and replacement thereof while the armband is being worn and in use.

For example, many common armband designs utilize a stretchable fabric defining a pocket to hold an electronic device; however, the soft and pliable nature of such products often causes difficulty in inserting and/or removing the device within the pocket. In particular, such armbands are known to collapse or bunch up when attempting to insert a device into the pocket while being worn. Similarly, these armbands stretch and conform to the body of the user, reshaping the device pocket and further increasing the difficulty of inserting a device therein while the armband is being worn.

Additionally, many of the current armbands available for securing a device require removal of protective device cases or similar accessories as these add additional shapes, thicknesses, and/or features to the electronic device, thus making it more difficult to readily and easily insert and remove the device from the armband. Alternatively, other current armbands address this problem by increasing the size of the pocket and including additional features such as zippers or fasteners to secure the pocket closed; however, these larger armbands may become cumbersome, particularly if the user is of a smaller stature, and these armbands still suffer from the same difficulties in easy insertion and removal of the device therein. Additionally, these larger armbands and/or armbands having a larger pocket may contribute to the less secure holding of the user's device, which may in turn cause bounce and/or movement of the device during activity. This may further disrupt the user's participation in such activities and may ultimately lead to the user discarding the armband or abandoning their activities earlier than they planned.

Generally, with regards to currently available armbands, the main goal is most commonly to secure the device therein and that removing the armband to access and/or replace the device is a "necessary inconvenience" in exchange for the secure device pocket. Other current armbands purport to allow easy insertion and removal while being worn, but tend over-claim universal compatibility while also having form factors that are cumbersome and less secure.

SUMMARY

The present disclosure addresses these and other issues by providing a wearable armband having a secure pocket defined therein for holding a user's personal cellphone or similar device. The armband may incorporate additional low friction liner panels allowing for fast and efficient removal and insertion of the user's device without removing the armband while simultaneously providing a secure hold to prevent movement or unwanted removal of the device from the armband. More particularly, in one example, the present disclosure relates to an adjustable armband for holding a phone or similar device during exercise activities. Specifically, in another example, the present disclosure relates to an adjustable armband with strategically placed low friction insert panels to allow for rapid insertion and removal of an electronic device while simultaneously providing a secure hold on the device while contained within the armband.

In one aspect, an exemplary embodiment of the present disclosure may provide an armband comprising: a strap and fastener operable to attach the armband about a user's arm; a first panel of material in operable connection to a second panel of material, the first and the second panels of material further defining a pocket therebetween; a first semi-rigid liner panel inside the pocket and connected to the first panel of material; and a second semi-rigid liner panel inside the pocket and connected to the second panel of material; wherein the pocket is operable to receive a device inserted therein while the armband is secured on the user's arm.

In another aspect, and exemplary embodiment of the present disclosure may provide a method of inserting a device into an armband comprising: engaging a strap and a fastener to secure the armband about a user's arm; inserting a device into a pocket of an armband having a first material layer having a first liner panel attached thereto and a second material layer having a second liner panel thereto; and securing the device within the pocket between the first and the second liner panels.

In yet another aspect, an exemplary embodiment of the present disclosure may provide an armband as substantially described herein.

In yet another aspect, an exemplary embodiment of the present disclosure may provide a method of using an armband as substantially described herein.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
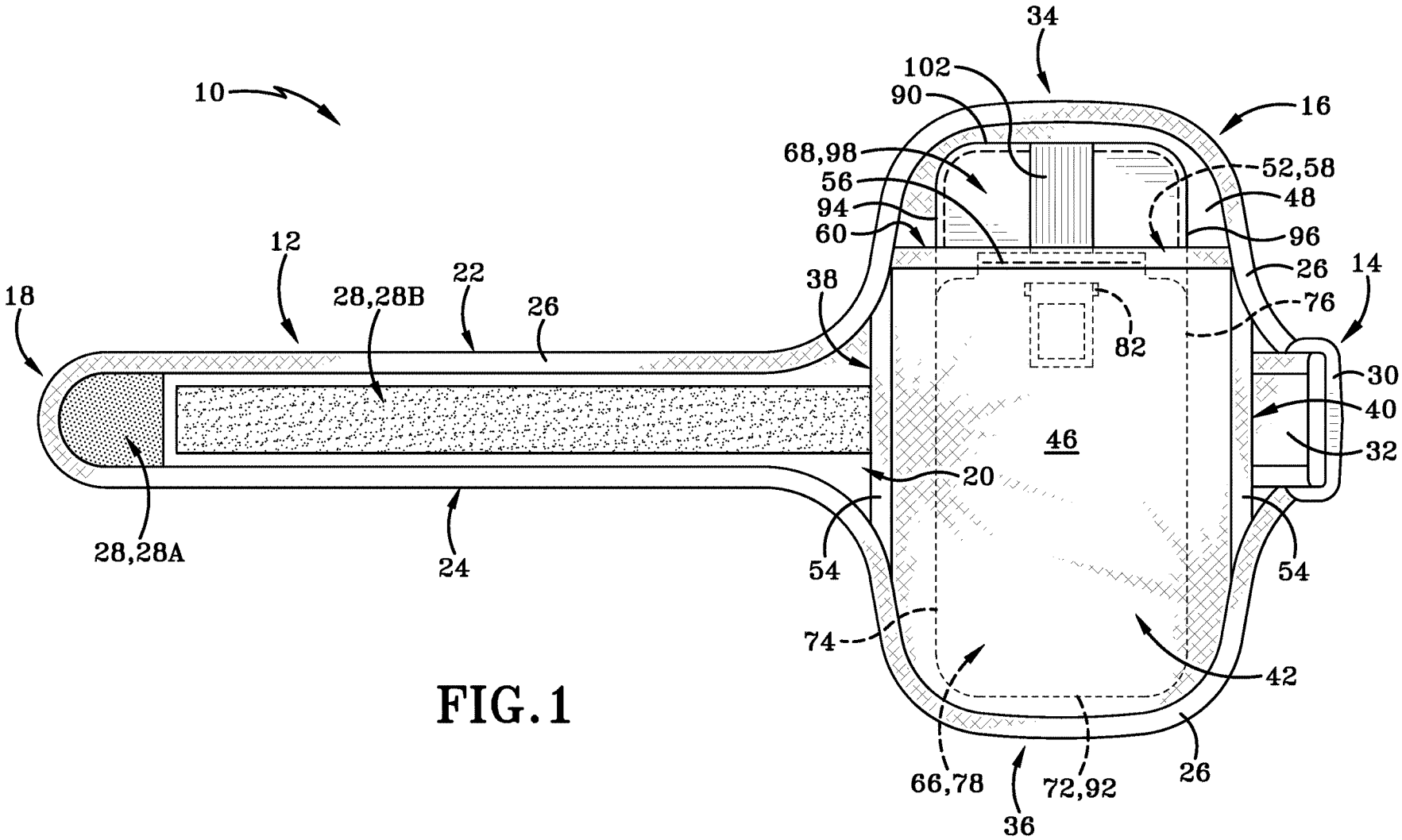
FIG. 1 is a front elevation view of an armband according to the present disclosure.
Figure 2:
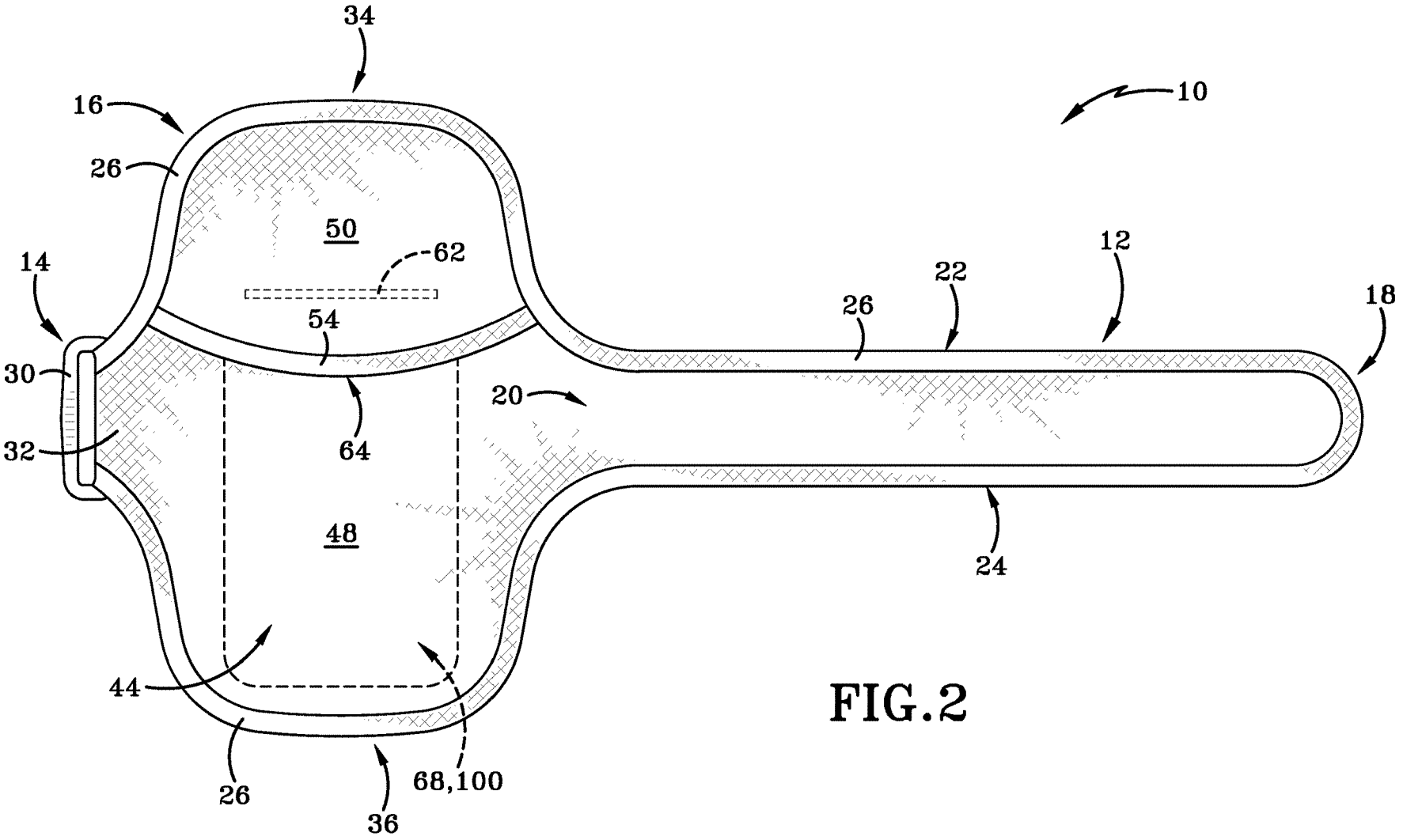
FIG. 2 is a rear elevation view of an armband according to the present disclosure.

With reference to FIGS. 1 and 2, an armband device holder is shown and generally referenced as armband 10. Armband 10 may be generally recognized as an exercise or activity accessory utilized to secure a cellular telephone or other similar device to a user's arm while the user is participating in an activity. Generally speaking, armband 10 may include an adjustable strap 12 and fastener 14 operable to secure the armband 10 to the user's person. Armband 10 may further include a body portion 16, or simply body 16, which may be the portion of armband 10 that interacts with and otherwise secures a device (such as a smartphone or similar device 104, discussed further below) therein.

Armband 10 may be generally constructed or formed of any suitable material and may be constructed as a single continuous piece of material or may be constructed of multiple pieces fixed together as dictated by the desired implementation. According to another aspect, armband 10 may be constructed of multiple layers or material that are stitched or otherwise secured together.

Armband 10 generally may be formed of any suitable material. According to one aspect, armband 10 may be constructed of a stretchable, moisture resistant and/or moisture wicking material such as spandex, neoprene, or the like. According to another aspect, armband 10 may be formed of any suitable material which may be coated or treated for moisture repellant and/or wicking properties. According to yet another aspect, armband may be formed of directional stretch material (i.e. material that has a greater amount of stretch in one direction relative to other directions) such as 4-way stretch neoprene. In this aspect, armband 10 may have a larger degree of stretch in a horizontal direction to provide a more custom and comfortable fit while having a lesser degree of stretch in the vertical direction to further support the stability of the device pocket (e.g. pocket 52) formed therein.

Armband 10 may be operable to secure a device, such as a smartphone or the like, to a user's arm during participation in an activity wherein the user may not be able to, or it is otherwise less desirable to, carry the user's device by another means. For example, it is less desirable to carry one's smartphone in a pants pocket while running. According to one aspect, exemplary activities may include exercise-related activities such as walking, jogging, running, hiking, biking, or the like or may include more strenuous exercise related activities such as weightlifting, or other similar activities. According to another aspect, armband 10 may be used for any reason or for any desired activity wherein it may be desirable to secure and support a user's cellular telephone or device in a hands-free configuration. According to this aspect, some examples of such activities may include yard work and yard maintenance, light construction activities, or the like.

Strap 12 of armband 10 may have a first end 18 spaced apart from a second end 20 defining a transverse or horizontal direction therebetween. Strap 12 may further have a top edge 22 spaced apart from a bottom edge 24 defining a vertical edge therebetween. First end 18 of strap 12 may be a suitable distance away from body 16 to provide sufficient material to surround a user's upper arm while being attached or otherwise affixed thereto, as discussed below. Strap 12 may be a portion of armband 10 that is formed from a continuous piece of material therewith or may alternatively be a separate piece of material affixed to armband 10 through any suitable means.

Strap 12, and/or armband 10 as a whole, may include welting or binding 26 provided around the edges thereof to provide secure stitching surface in securing the armband 10 together while also providing an aesthetically pleasing and finished appearance to strap 12 and to armband 10 generally.

Strap 12 may further include one or more sections of hook and loop closure 28 material consisting of at least one panel of hook material 28A and at least one panel of loop material 28B for interaction therebetween, as discussed below. Alternatively, strap 12 may include any suitable attachment means, including, but not limited to, buckles, clips, or the like.

Fastener 14 may include a ring 30 connected to body 16 of armband 10 by an anchor 32. Strap 12 may threadably engage through ring 30, and may be folded back upon itself to allow the hook material 28A to engage with loop material 28B to provide an adjustable fit for armband 10 about a user's upper arm.

Ring 30 may generally be an elongate member with a central opening defined therein and may be formed of any suitable material including plastic, metal, reinforced fabric, or any other suitable material and may be fixed to anchor 32 through any suitable or desired means including stitching, welding, or the like. As with strap 12, anchor 32 may be a portion of armband 10 that is formed from a continuous piece of material or may be a separate piece of material affixed thereto through any suitable means.

Generally speaking, strap 12 and fastener 14 may be of any suitable design, including designs similar to those used on other existing armbands, and may operate according to its expected operation and/or use thereof.

Body 16 of armband 10 may be generally rectangular or oval-shaped and may be sized to accept or otherwise contain a smartphone or other similar device therein. Body 16 may generally include a top 34 spaced vertically apart from a bottom 36, a first side 38 spaced transversely or horizontally apart from a second side 40, and front 42 opposite a back 44 and defining the overall thickness of body 16 therebetween.

As the most common personal devices contemplated for use with armband 10 are cellular telephones, including smartphones and the like, body 16 may be generally taller than it is wide, i.e. the vertical dimension between the top and bottom 34 and 36 may exceed the horizontal dimension between first side and second side 38 to provide the generally rectangular shape of body 16 to correspond to the generally rectangular shape of most cellular devices on the market today. It will be understood, however, that the shape and size of body 16 may be modified or adapted for use with other devices, or for other uses, while maintaining the key features and benefits described further herein.

Body 16 may be constructed in a layered configuration having a plurality of material layers secured together to form body 16 as a whole. In particular, body 16 may have a first layer of material 46 in front of a second layer of material 48, which may define the back of armband 10. Body 16 may have a third layer of material 50, which may be a cover 50, which may be reversible to cover or uncover a user's device while contained within pocket 52 of armband 10, as discussed further herein. Any or all of first, second and/or third layer of materials 46, 48 and/or 50 may include additional stitching and/or welting or binding 54, which may be both decorative and/or aesthetically pleasing while functionally connecting and securing material layers 46, 48, and 50 together to form body 16, as discussed further herein. According to one aspect, binding 26 and binding 54 may be substantially identical but for their placement on armband 10, with binding 26 surrounding the outermost edges of armband 10 generally while binding 54 may be provided on inner seams and/or non-continuous seams as seen in the figures. The manner in which first, second and third material layers 46, 48 and 50 may be attached may further define a pocket 52 which may be the area in which a user device may be inserted, as discussed further herein.

First material layer 46 may be secured to second material layer 48 on the sides and bottom thereof (corresponding to sides 38 and 40 and bottom 36 of body 16) to form pocket 52 between the first and second material layers 46 and 48. Specifically, first material layer 46 may be the front panel of pocket 52 while second material layer 48 may be the back panel of pocket 52. First and second material layers 46 and 48 may be secured together by any suitable means, including stitching, welding, or the like. According to one aspect, first and second material layers 46 and 48 may be secured together by stitching and may include binding 54 along the seams therebetween for additional support and for an aesthetically pleasing finish. According to another aspect, first and second material layers 46 and 48 may be secured using a decorative stitch or finishing technique, as desired.

First material layer 46 may have a top edge 60 which is not secured to the second material layer 48 to further define the opening 58 of pocket 52. Top edge 60 of first material layer 46 may be vertically below the top 34 of body 16 may include binding 54 to provide a secure and aesthetically pleasing finish. Binding 54 may further provide additional durability to pocket 52 opening 58 for repeated use. Top edge 60 may further include additional stitching 56 for operable connection with a first liner panel 66, as discussed further below.

Second layer of material 48 may generally define the overall size of body 16 in that a top, bottom, and sides thereof may generally correspond to the top 34, bottom 36, and sides 38 and 40 of body 16. Second material layer 48 may include an aperture or slit 62 defined therethrough for use as an additional accessory pocket, as discussed further below. As mentioned above, second material layer 48 may generally be the back panel of pocket 52 opposite the first material layer 46, and may extend vertically above the top edge 60 of first material layer 46 to further separate the back of device 104 from the user's arm while armband 10 is in use. Accordingly, second material layer 48 may be vertically larger than first material layer 46 while generally having the same or nearly the same horizontal width.

Figure 3:
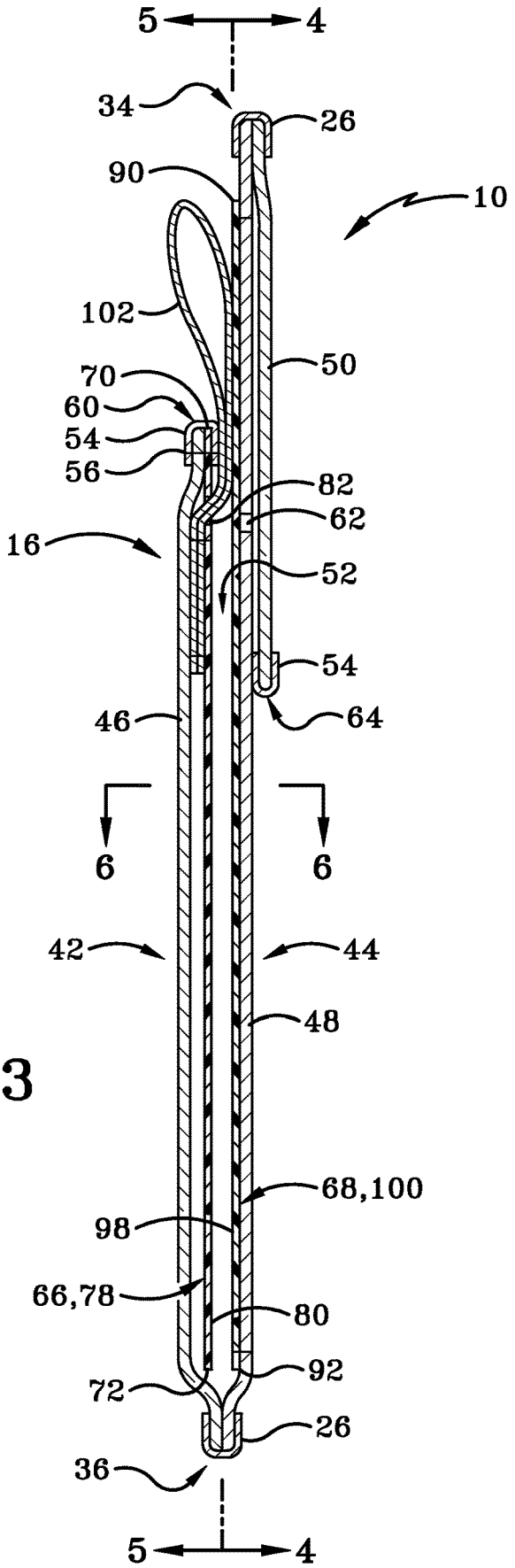
FIG. 3 is a side elevation cross sectional view of the armband body according to one aspect of the present disclosure.
Figure 5:
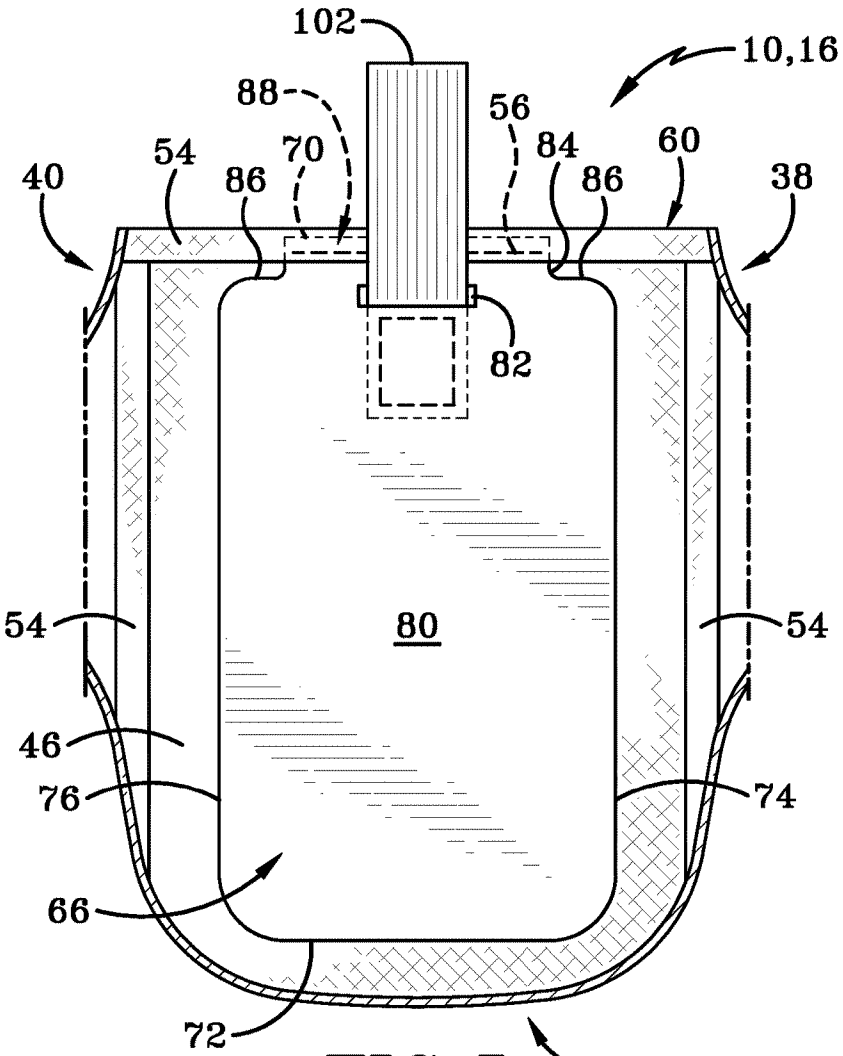
FIG. 5 is a rear cross sectional view of an armband taken in the direction of the line indicated in FIG. 3 according to one aspect of the present disclosure.
Figure 4:
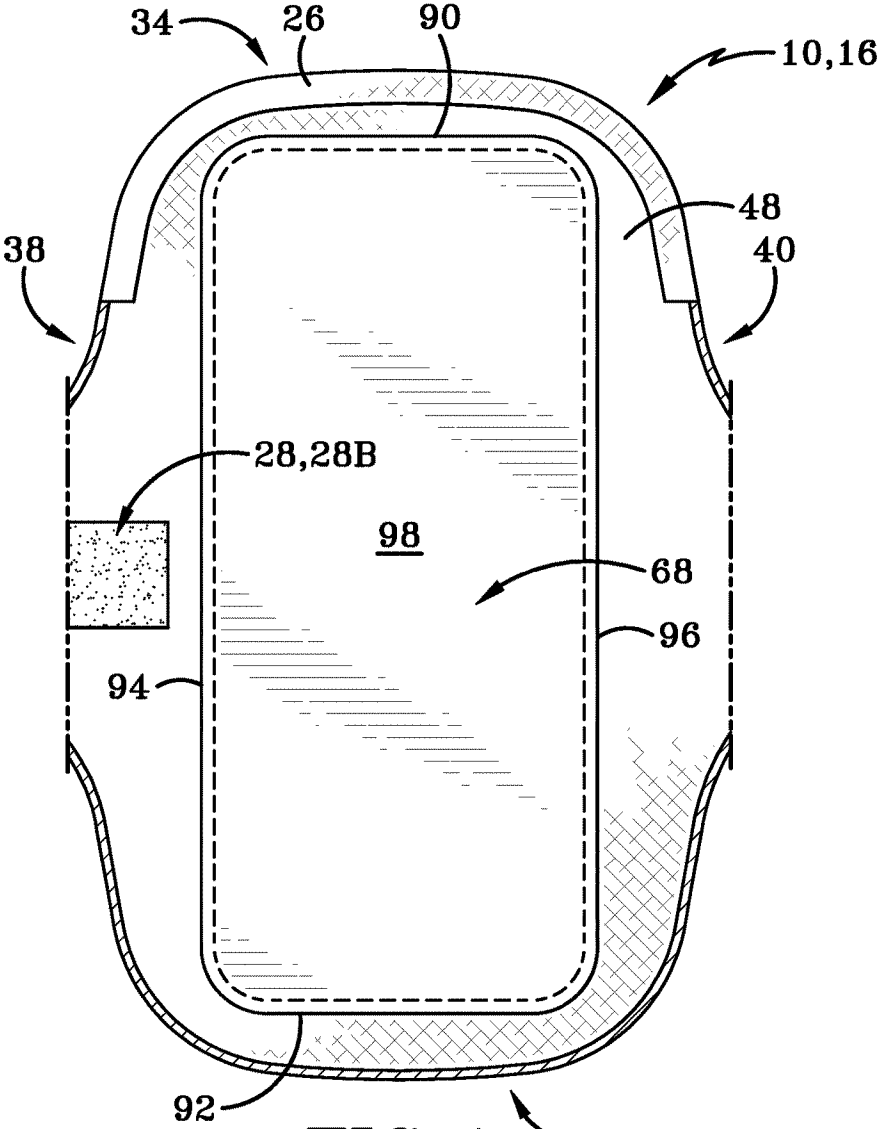
FIG. 4 is a front cross sectional view of an armband taken in the direction of the line indicated in FIG. 3 according to one aspect of the present disclosure.
Figure 6:
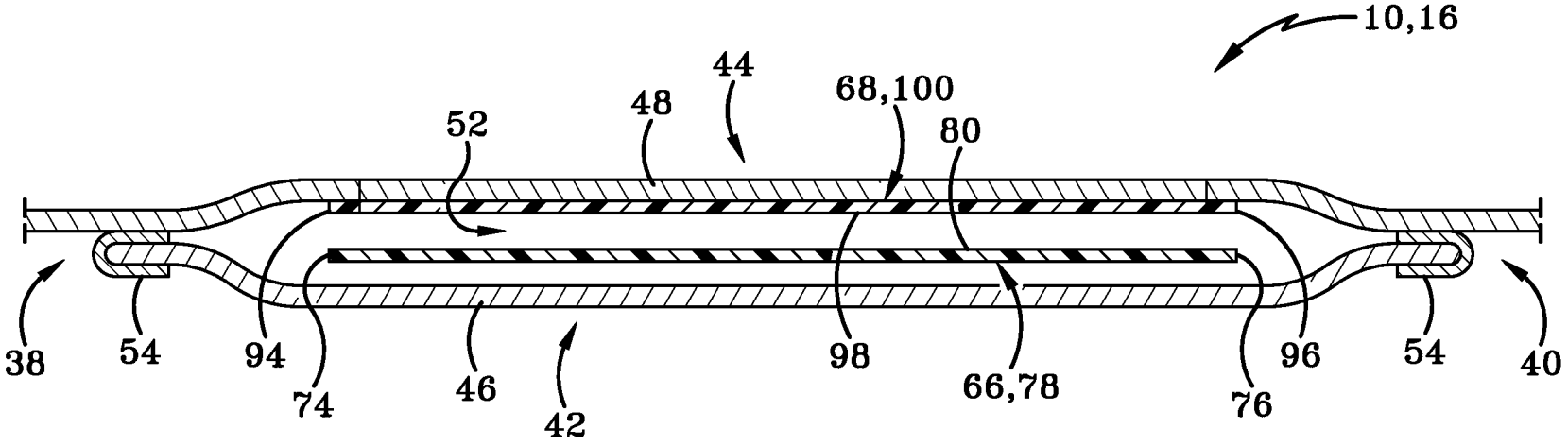
FIG. 6 is a top cross sectional view of an armband taken in the direction of the line indicated in FIG. 3 according to one aspect of the present disclosure.

Third layer of material 50, may be connected to second material layer 48 on a top and sides thereof, as generally corresponding to the top 34 and sides 38 and 40 of body 16. Third material layer 50 may have a bottom edge 64 which is not which is not secured to the second material layer 48. Bottom edge 64 of third material layer 50 may terminate vertically below the top edge 60 of first material layer 46 and may likewise include binding 54 to provide a secure and aesthetically pleasing finish. As mentioned herein, third material layer 50 may define a cover which may be behind the second material layer 48 when in an open position (See e.g. FIGS. 2 and 3) and in front of second material layer 48 and at least a portion of first material layer 46 when in a closed position (See e.g. FIGS. 7E and 8). The third material layer 50 (as cover 50) is discussed further below with regards to the operation and use of armband 10.

Each of first, second, and third material layers 46, 48, and 50 may be constructed of similar materials, as dictated by the desired implementation. Alternatively, first, second, and/or third material layers 46, 48, and 50 may be formed of any suitable materials, or any combination of materials, as desired. The material chosen for material layers 46, 28, and/or 50 may be selected for the natural ability to reduce or eliminate moisture from reaching the device within pocket 52, or may alternatively be treated or coated for similar performance. By way of one non-limiting example, each of first, second, and/or third material layers 46, 48, and/or 50 may be formed of four-way stretch neoprene. According to another non-limiting example, third material layer 50 (as cover 50) may be formed of nylon textile material, nubuck leather, synthetic leather, or other similar materials, or suitable combinations thereof. According to one aspect, the cover 50 may have a waterproof or water resistant material, such as nylon textile, on one side thereof (e.g. the side exposed to the outside environment when the cover 50 is closed, as discussed below) and a second material on the other side (such as nubuck, treated neoprene, or the like) which may protect the device in pocket 52 from damage while further contributing to the waterproof or water resistant properties of cover 50. Similarly, first and second material layers 46 and 48 may be combination materials having a first type of material on one side and a second material on the opposite side, as desired.

With reference now to FIGS. 1-6, body 16 may further include a first liner panel 66 and a second liner panel 68. First and second liner panels 66 and 68 may be formed of any suitable rigid or semi-rigid material having lower coefficient of friction (COF) than the material layers 46, 48, and 50, and having high durability. The first and second liner panels 66 and 68 may line the interior of pocket 52, as discussed below, and the rigidity of the material selected for first and second liner panels 66 and 68 may support the structure of pocket 52 of body 16 when a device 104 is not inserted therein, as discussed below. According to one aspect, first and second liner panels 66 and 68 may be formed of a material having a low COF such as a polymer plastic, or other similar material. As used herein, a low COF (i.e. the ratio between friction force and normal force) is contemplated to include materials with a COF below 1, where a coefficient of 1 represents the point where friction force is equal to the gravity force of the weight of the material.

According to another aspect, first and second liner panels 66 and 68 may be formed of polypropylene (PP). PP is a tough, durable, and flexible polymer that may impart some flexible rigidity into pocket 52 while having a low COF to allow for ease of insertion and removal of device 104 therefrom, as discussed below. PP, like all materials, has a varying COF dependent upon the type of material the PP interacts with; however, generally speaking, PP has an approximate dynamic COF between 0.28 (plastics to steel) to 0.44 (plastics to plastic) and a static COF of 0.30 (plastics to steel) to 0.76 (plastics to plastics). For reference, materials with a COF below 0.1 are considered lubricous materials (e.g. lubricants).

First liner panel 66 may have a top edge 70 spaced vertically apart from a bottom edge 72, a first side 74 spaced horizontally apart from a second side 76, and a front 78 opposite a back 80 in defining the thickness of first liner panel 66 therebetween. The vertical height of first liner panel 66 may be slightly smaller than the vertical height of first material layer 46. Similarly, the horizontal width of first liner panel 66 may be slightly less than the horizontal width of first material layer 46. According to one aspect, the first liner panel 66 may have a thickness of approximately 1 mm. First liner panel 66 may further have an aperture 82 defined therethrough, which may allow for operational engagement with a loop 102, as discussed further below. The top edge 70 of first liner panel 68 may also include a neck 84 and a pair of shoulders 86 which may further define a tab 88.

First liner panel 66 may be affixed within the pocket 52 with the back 80 thereof against the first layer of material 46 of body 16. Stitching 56 may be provided at the top edge 60 of first layer of material 46 to secure the tab 88 of first liner panel 66 within the binding/seams 54. The attachment of just tab 88 to first layer of material 46 may allow the remainder of first liner panel 66 to hang free within pocket 52. This may impart additional flexibility to the front of pocket 52 during insertion and removal of a device 104, as discussed below. Additionally, by only connecting the tab 88 to the top edge 60 of first material layer 46, the pocket 52 may remain pliable and flexible allowing the pocket 52 to expand to accommodate devices 104 of varying sizes, thicknesses, and/or devices 104 having additional device accessories, such as cases and the like.

The aperture 82 defined through first liner panel 66 may permit a pull tab or loop 102 to extend therethrough. In particular, loop 102 may be a material loop wherein the open ends of the loop 102 may extend through the aperture 82 from the front side 78 of first liner panel 66 to the back side 80 thereof. Loop 102 may be formed of any suitable material, including elastic or the like, and the open ends thereof may be affixed to the back side 80 of first liner panel 66 through stitching, welding, or other similar means. According to one aspect, the open ends of the loop 102 loop may be box stitched to the back 80 of first liner panel 68. The loop 102 may be secured exclusively to first liner panel 66 and may be otherwise unattached to first or second material layers 46 and/or 48 or any other portion of body 16 for reasons discussed further below with regards to the operation and use of armband 10.

Similar to first liner panel 66, second liner panel 68 may have a top 90 spaced vertically apart from a bottom 92, a first side 94 spaced horizontally apart from a second side 96, and a front 98 opposite a back 100 and defining the thickness of second liner panel 68 therebetween. The vertical height of second liner panel 68 may be slightly smaller than the vertical height of second material layer 48 (and body 16 generally). Similarly, the horizontal width of second liner panel 68 may be slightly less than the horizontal width of second material layer 48. According to one aspect, the second liner panel 68 may have a thickness of approximately 0.5 mm.

Second liner panel 68 may be secured to the second layer of material 48 of body 16 and may be stitched thereto around the perimeter of one or more of the four (top 90, bottom 92, first side 94, and second side 96) edges to affix second liner panel 68 in place within pocket 52. This stitching configuration allows second liner panel 68 to remain securely positioned and provide a "backing" for a device such as a smartphone 104, contained within pocket 52 as discussed further below. Slit 62 defined through second layer of material 48 may fall vertically between the top edge 90 and bottom edge 92 of second liner panel 68 such that slit 62 may provide access to the space between the back 100 of second liner panel 68 and the second material layer 48. This space may define an accessory pocket or secondary pocket that may allow the storage of small items that may be beneficial for the user to carry in addition to device 104. The accessory pocket or secondary pocket is bound by the stitching or connection of the perimeter of second liner panel 68 to the second layer of material 48. For example, this accessory pocket may allow a user to carry a key, cash, ID, a credit card, or the like while securing the same within the accessory pocket. As this accessory pocket is separate from pocket 52, this may further prevent loss of such items through the removal of device 104 from pocket 52.

Having thus described the elements and components of armband 10, the operation of and a method of use for armband 10 will now be discussed, along with the benefits provided imparted from the use of armband 10.

As mentioned herein, armband is contemplated for use with a personal device 104, such as a cellular telephone, including smartphones, or the like; however, it will be understood that armband could be used with a wide variety of objects and devices, and can be readily adapted for use with other similar items. Accordingly, although described and shown herein in use with a smartphone (standing in for device 104), it will be understood that this is an exemplary use and not a limiting use of armband 10. Accordingly, references to smartphone 104 hereafter are to be understood to include any suitable device 104, as dictated by the desired implementation of armband 10.

With reference to FIGS. 7A-7E, armband 10 is contemplated for use being worn about a user's upper arm 106, as mentioned above and illustrated therein. Accordingly, to position armband 10 on a user's upper arm 106, the user may place the body 16 in the desired position on their arm 106 and may then wrap strap 12 around their arm 106. The user may then feed the first end 18 thereof through the ring 30 of fastener 14 and may double back or may double strap 12 back on itself to secure the hook and loop fasteners 28A and 28B together to provide a comfortable yet secure engagement with the user's upper arm 106.

Figure 7A:
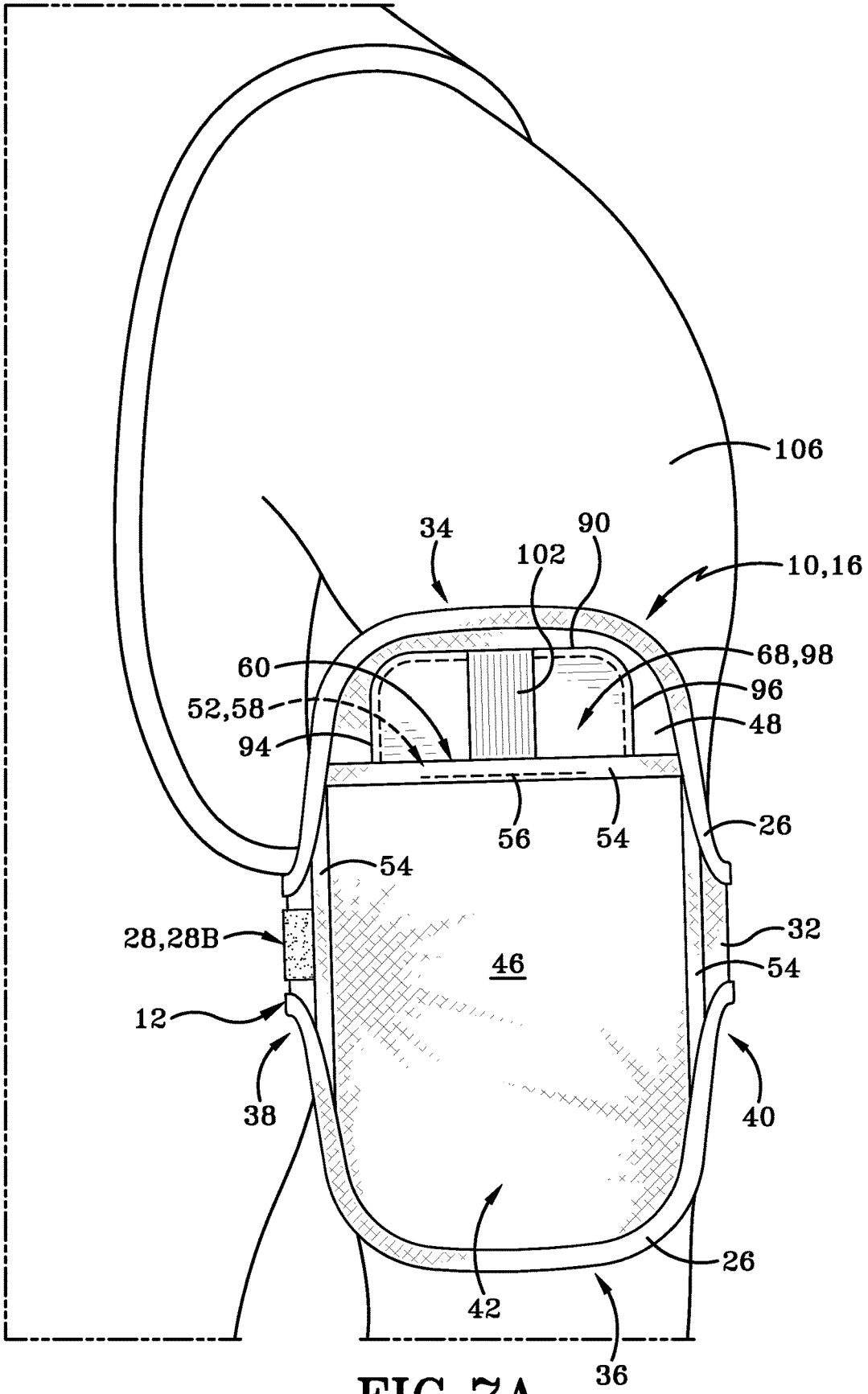
FIG. 7A is a front elevation operational view of an armband as worn by a user.
Figure 7B:
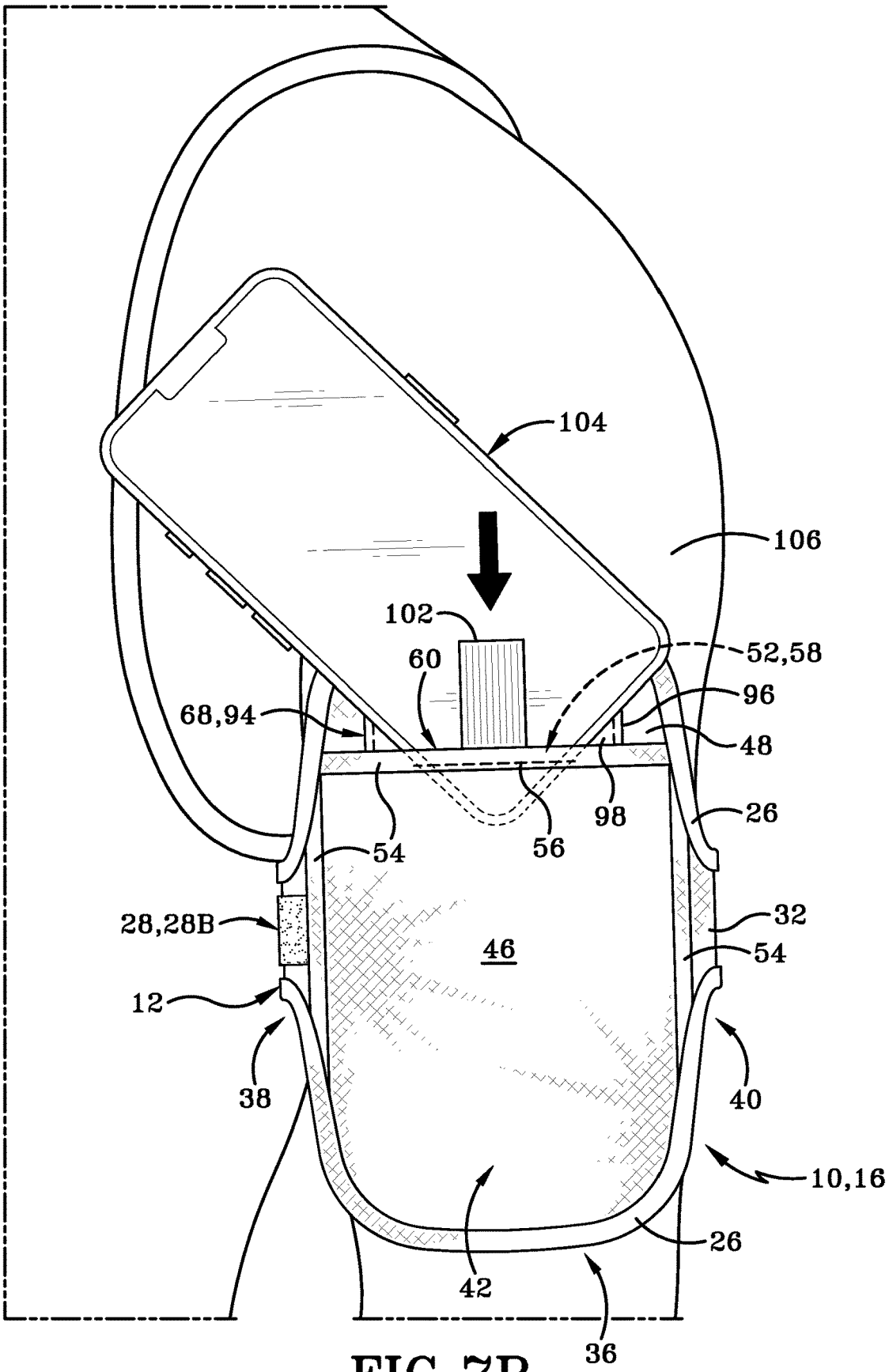
FIG. 7B is a front elevation operational view of an armband as worn by a user with a device being inserted therein.
Figure 7C:
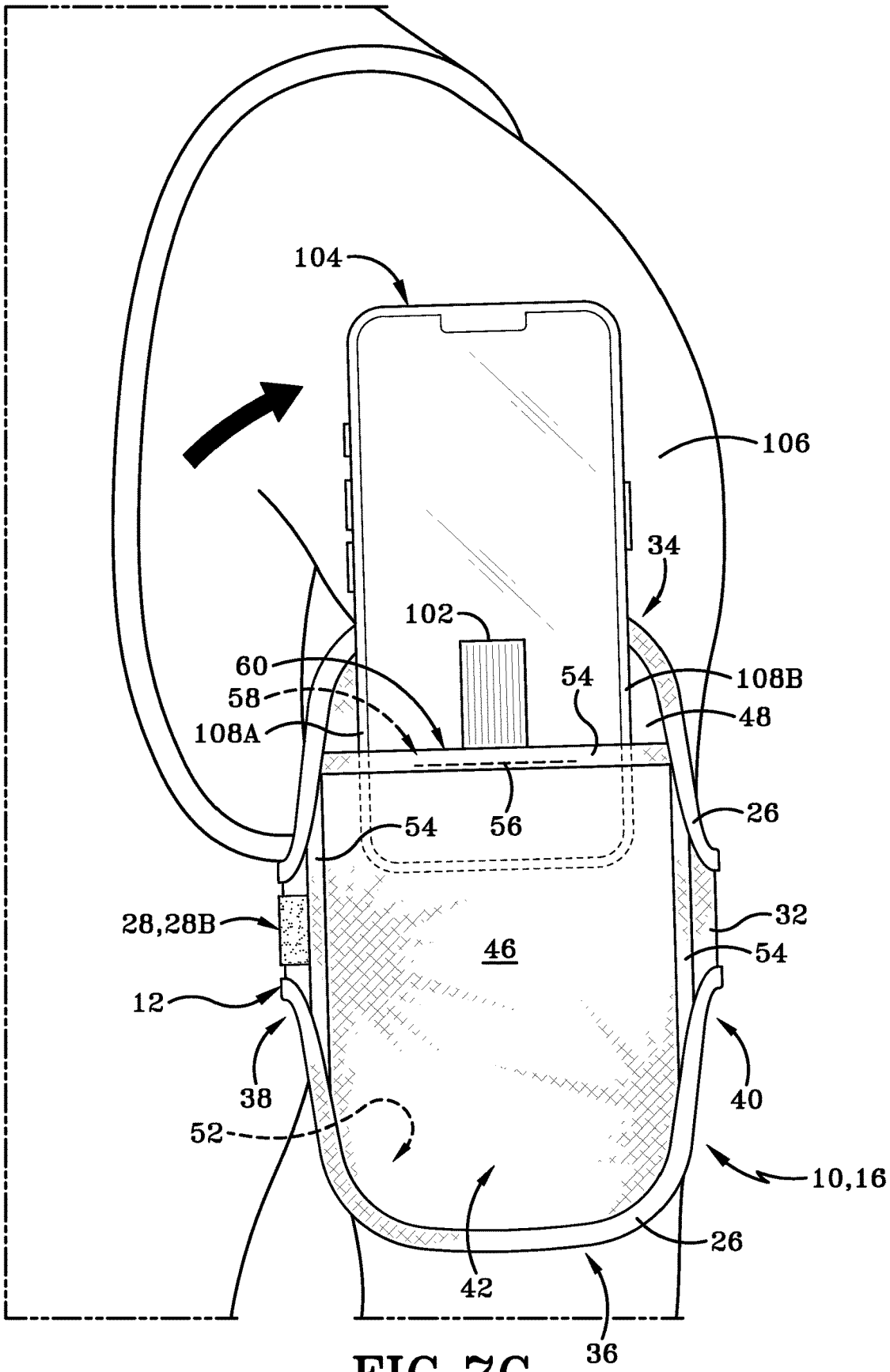
FIG. 7C is a front elevation operational view of an armband as worn by a user with a device being inserted therein.

Once armband 10 is engaged about the user's arm 106, a user may insert a device 104 into pocket 52 through opening 58 to be securely contained therein. In particular, with reference to FIGS. 7B and 7C, smartphone 104 may be inserted into pocket by first angling smartphone 104 and inserting a corner thereof through opening 58 and between first and second liner panels 66 and 68 (FIG. 7B) before rotating the smartphone 104 to a vertical position and moving the smartphone downward into the pocket 52 (FIG. 7C).

Figure 7D:
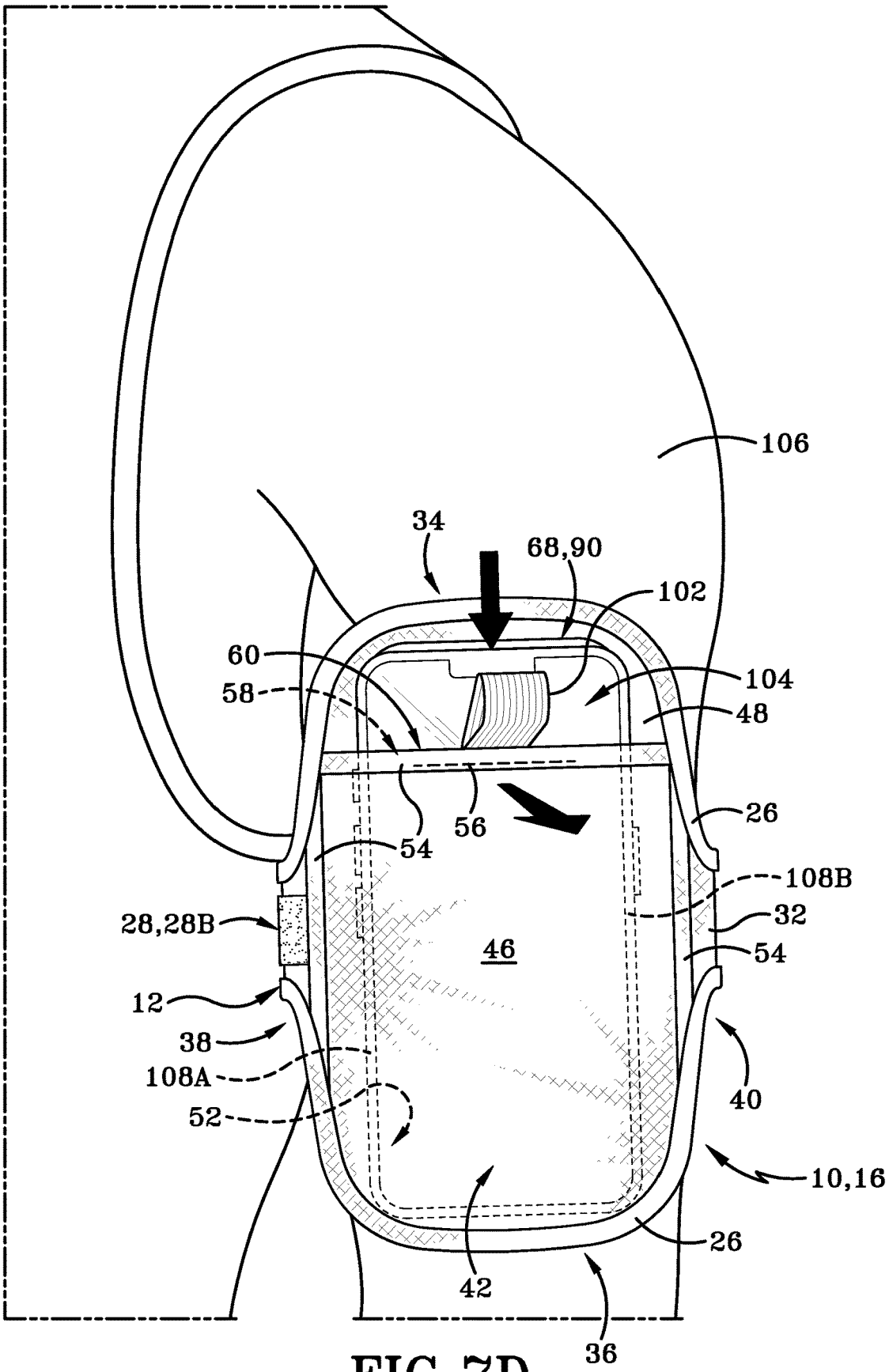
FIG. 7D is a front elevation operational view of an armband as worn by a user with a device being inserted therein.

With reference to FIG. 7D, once smartphone 104 is partially inserted into pocket 52, inserted, loop 102 may be pulled outwardly away from smartphone 104 to assist the user in inserting the smartphone 104 into the pocket and to provide additional clearance for the smartphone 104 to be inserted. In particular, loop 102 may be engaged by the user's finger and may serve as an anchor point to then allow the user to simultaneously pull the loop 102 while pushing down on the smartphone 104 using their thumb. Similarly, pulling loop 102 may cause the size of the opening 58 to pocket 52 to increase.

While pulling loop 102 is not always a necessary step in the use of armband 10, the loop 102 may facilitate the insertion of a smartphone 104 by serving as an anchor for the user's hand while also allowing for a wider opening 58 to pocket 52 to accommodate a smartphone 104 having a bulkier or larger case, or a textured (such as a rubberized or silicone based) gripping case. In pulling loop 102 away from the smartphone 104, the attachment of loop 102 to the back of first insert panel 66 may allow some slight flexing of first insert panel 66 to further facilitate the insertion of smartphone 104 into the pocket 52.

Figure 7E:
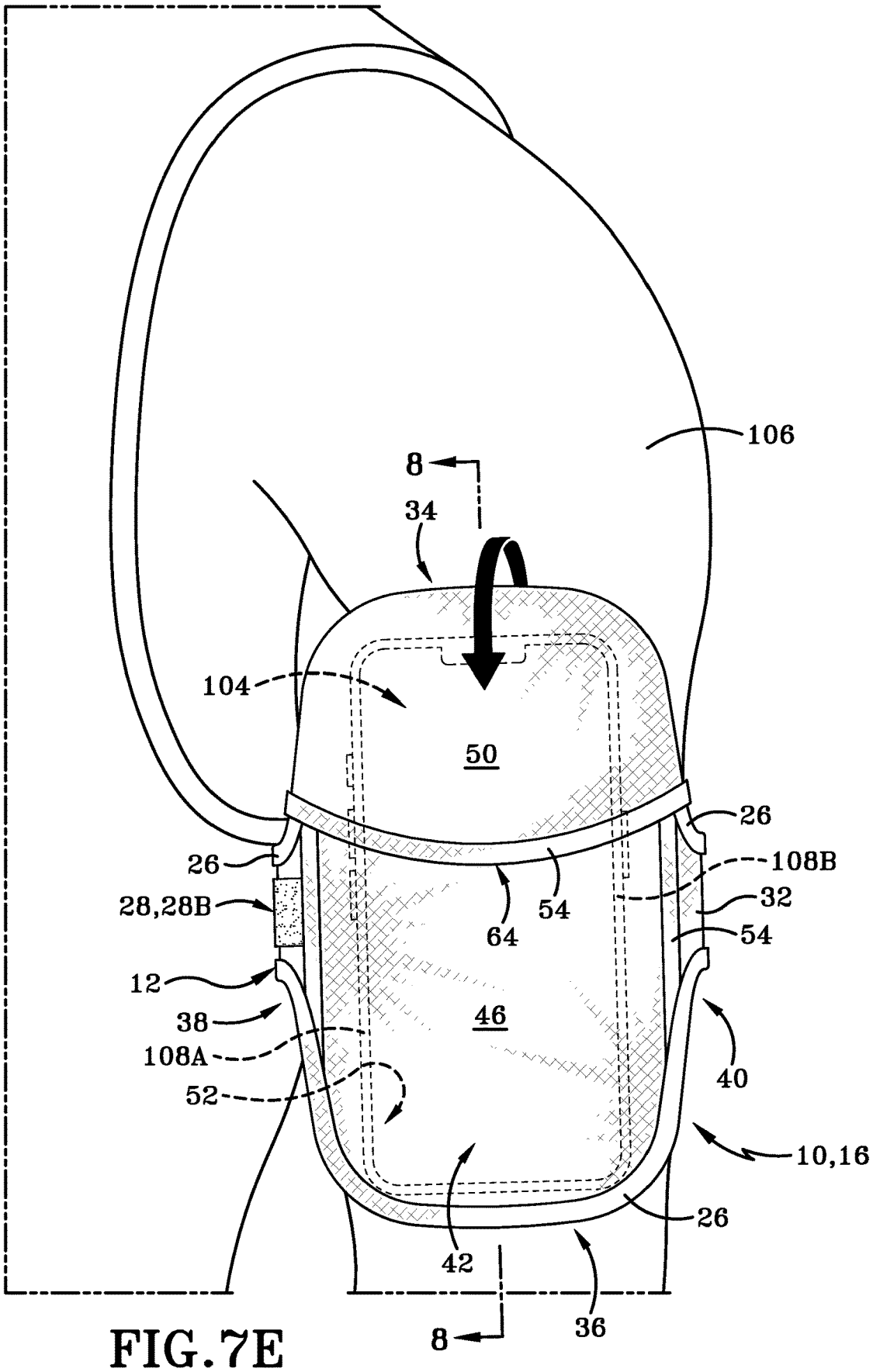
FIG. 7E is a front elevation operational view of an armband as worn by a user with a device fully inserted therein and with an additional cover provided over the secured device.

If desired, as seen in FIG. 7E, cover 50 (i.e. third material layer 50) may be flipped up and over the top 34 of body 16 to reverse its position from behind second layer of material 48 (open position) to in front of both first and second material layers 46 and 48 (closed position) to provide additional protection for smartphone 104 by extending third material layer 50 over the top thereof. This may provide a more secure placement within pocket 52 and may further provide additional protection from accidental damage from the elements, bumping the user's arm 106 against a surface, or other similar interactions. In this position, as mentioned previously herein, the bottom edge 64 of third material layer 50 may extend below top edge 60 of first material layer 46 to overlap at least a portion of first material layer 46 to further secure smartphone 104 within pocket 52.

Figure 8:
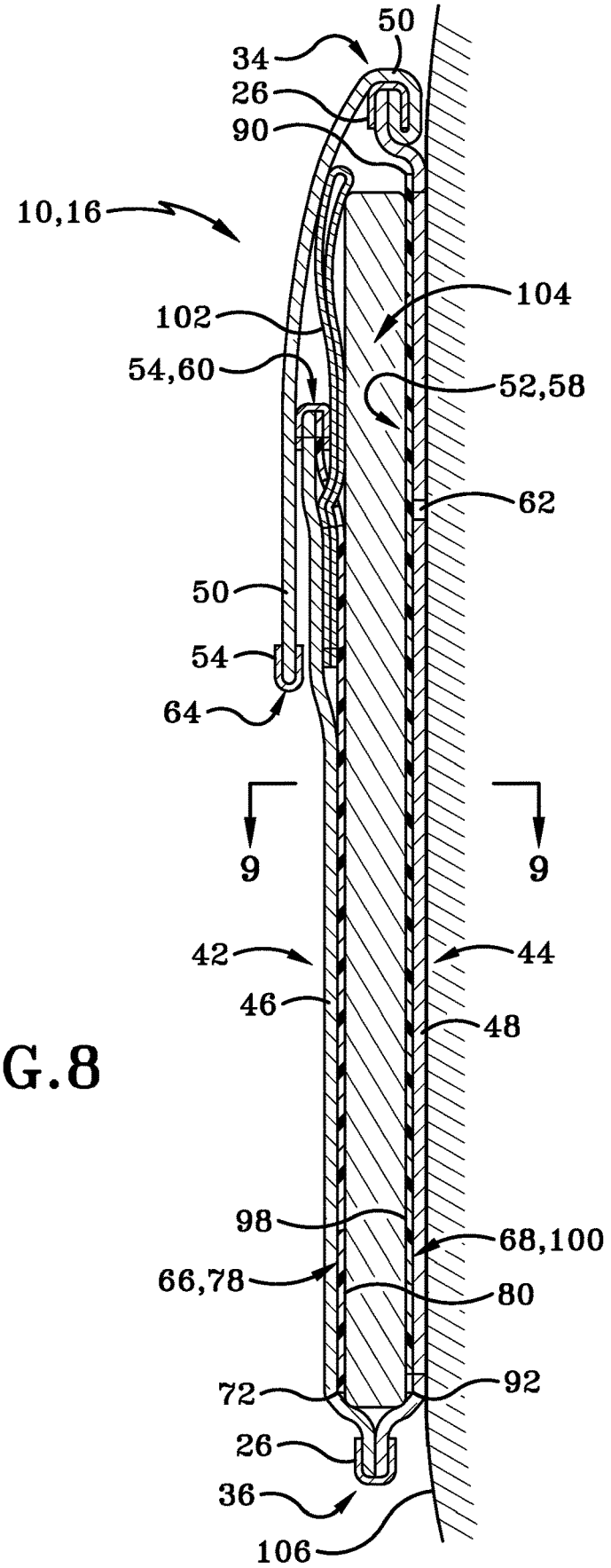
FIG. 8 is a side cross sectional operational view taken in the direction of the line indicated in FIG. 7E.
Figure 9:
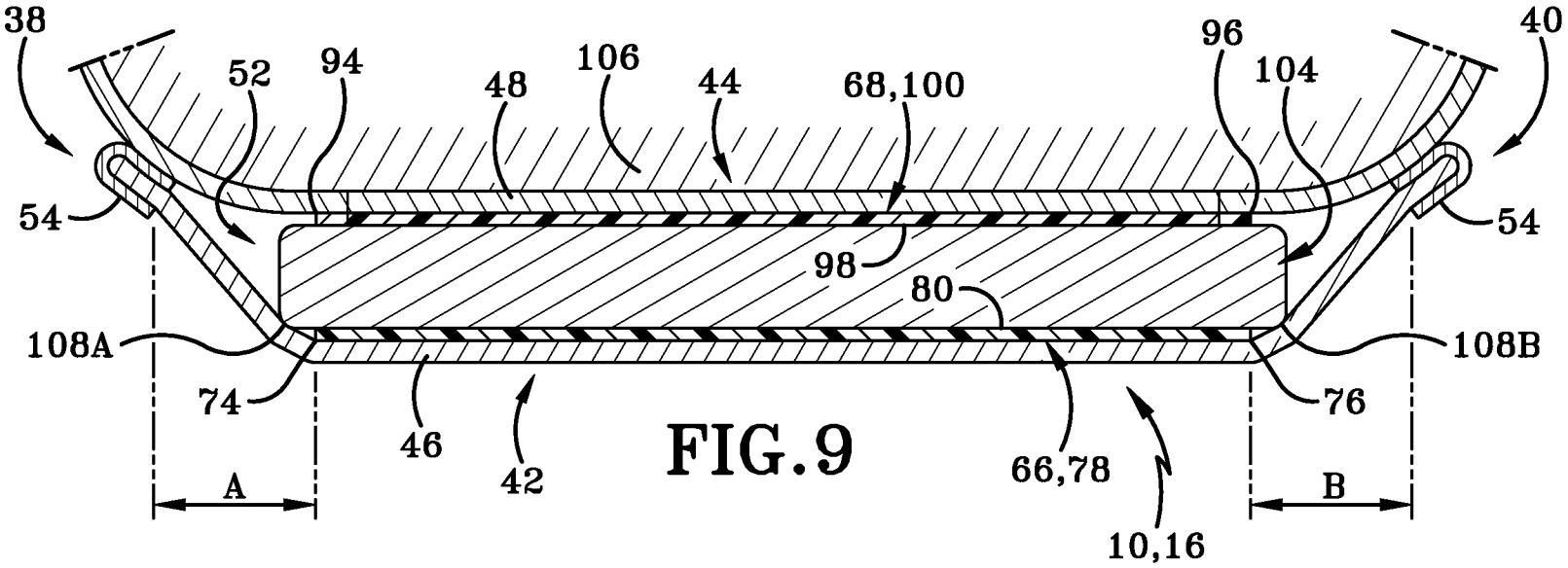
FIG. 9 is a top cross sectional operational view taken in the direction of the line indicated in FIG. 8.

With reference to FIG. 8 and FIG. 9, once the smartphone 104 is fully inserted within the pocket 52 (and cover 50 folded over the opening 58 of pocket 52 if desired and in the closed position), the smartphone 104 will be securely held in position against and in between the first and second liner panels 66 and 68. First and second liner panels 66 and 68 may then help protect the smartphone 104 from accidental damage in that the rigid nature of first and second liner panels 66 and 68 may disperse or prevent impact damage to the smartphone 104.

As best seen in FIG. 9 and as mentioned above, armband 10 may conform to the shape of the user's arm 106, causing first material layer 46 to stretch around the edges of smartphone 104 to provide targeted tension in the armband 10 to securely hold the smartphone 104 within the pocket 52. This stretch may occur across the entirety of first material layer 46, but particularly in the regions indicated at references A and B in FIG. 9. In regions A and B, first layer of material 46 will be pulled tightly against the edges (shown as edge 108A in region A and edge 108B in region B) of smartphone 104 to further secure device therein when the strap 12 is secured about a user's arm 106.

The inclusion of first and second liner panels 66 and 68, in addition to the structural rigidity and protection from impact, may further facilitate easy and rapid insertion of smartphone 104 into and removal of smartphone 104 out of pocket 52 due to the lower COF, as discussed herein. Specifically, the rigidity of first and second liner panels 66 and 68 may prevent the pocket 52 from collapsing when inserting a smartphone 104 into pocket 52. Conversely, when removing smartphone 104 from pocket 52, the first and second liner panels 66 and 68 may prevent unwanted snagging or gripping of the smartphone 104 and/or accessories by the material of armband 10.

Figure 10:
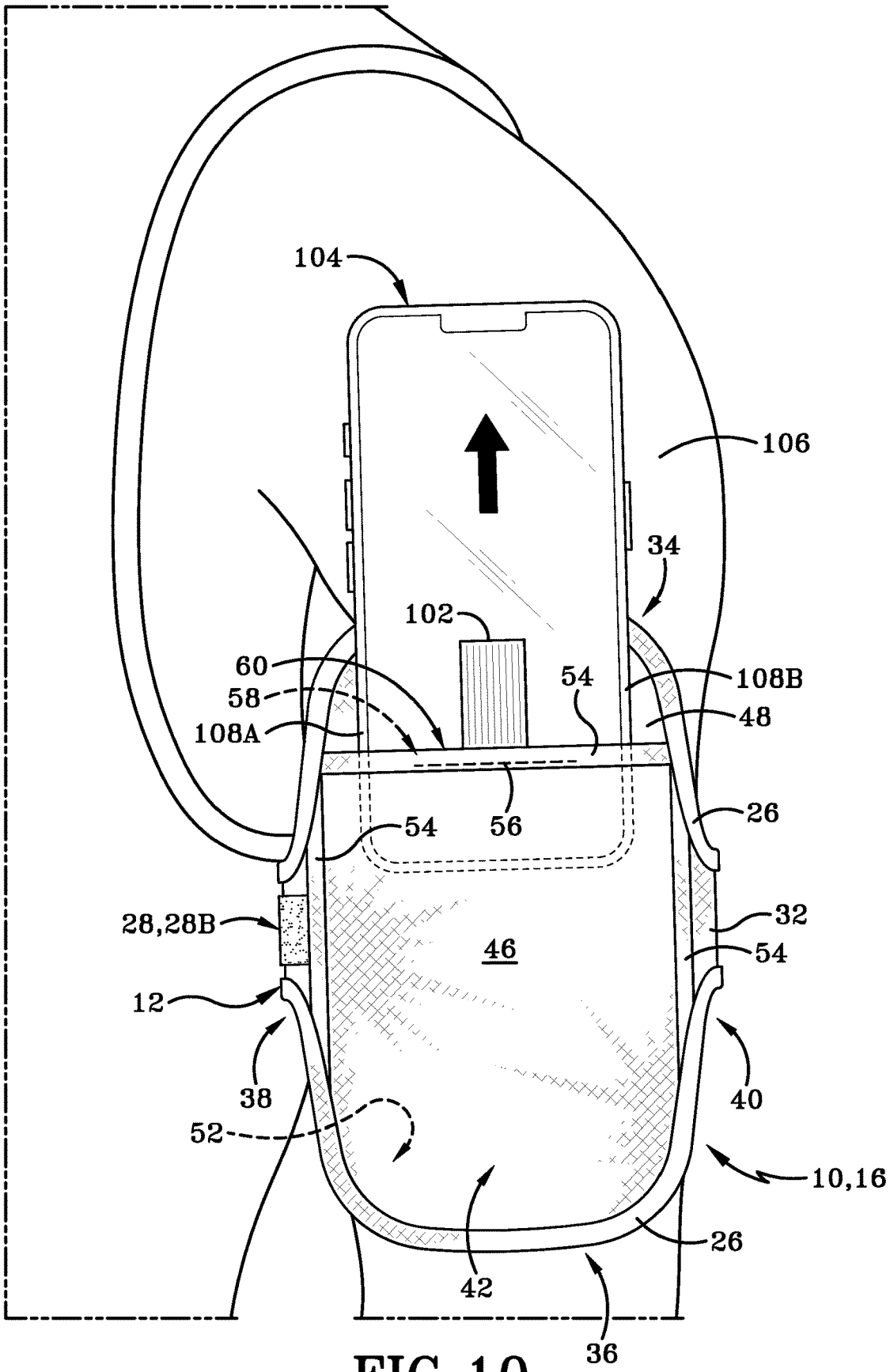
FIG. 10 is a front operational view of an armband with a device being removed therefrom according to one aspect of the present disclosure.

With reference then to FIG. 10, removal of device 104 from pocket 52 is as simple as pulling device upwards out of pocket 52, as shown therein. If cover 50 is in place in the closed position prior to removal, cover 50 may be first flipped up and towards the back 44 of body 16 of armband 10 to move cover 50 back into the open position, thus allowing full access to the smartphone 104, as desired.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. An armband comprising:

a strap and fastener operable to attach the armband about a user's arm;

a first outer panel of material in operable connection to a second outer panel of material, the first and the second outer panels of material further defining a pocket therebetween;

a first liner panel inside the pocket, wherein the first liner panel is comprised of a polymer material, and the first liner panel comprises a top edge that extends upward within the pocket, and wherein the top edge is connected with an inner surface of the first outer panel and a remainder of the first liner panel hangs free within the pocket, wherein the first liner panel further comprises that the top edge includes a neck and a pair of shoulders that define a tab, and the tab is upwardly extended within the pocket and the tab connected with the inner surface of the first outer panel;

a second liner panel inside the pocket and connected to the second outer panel of material;

wherein the pocket is operable to receive a device inserted therein while the armband is secured on the user's arm, and wherein the first liner panel and the second liner panel assist insertion of the device within the pocket, assist retention and securement of the device within the pocket by enabling the first outer panel of material to apply targeted tension upon the device, and assist removal of the device from the pocket.

2. The armband of claim 1, further comprising:

a loop operably connected to the first liner panel and extending out of an opening of the pocket.

3. The armband of claim 1, wherein the polymer material is a low friction material having a coefficient of friction less than 1.

4. The armband of claim 3, wherein the polymer material is a low friction material having a coefficient of friction less than 0.5.

5. The armband of claim 4, wherein the low friction material further comprises:

polypropylene.

6. The armband of claim 1, wherein the first and second outer panels of material further comprise:

a stretchable fabric.

7. The armband of claim 6, wherein the stretchable fabric further comprises:

at least one of neoprene and spandex.

8. The armband of claim 1, further comprising:

a cover connected to the second outer panel, wherein the cover is moveable between an open position and a closed position, wherein when the cover is in the open position an opening to the pocket is accessible and when the cover is in the closed position the opening to the pocket is inaccessible.

9. The armband of claim 1, further comprising:

a vertical first side edge of the first liner panel, wherein the vertical first side edge is disconnected from the first outer panel; and a vertical second side edge of the first liner panel, wherein the vertical second side edge is disconnected from the first outer panel.

10. The armband of claim 1, wherein the second liner panel further comprises:

a perimeter of the second liner panel, wherein the perimeter of the second liner panel is connected to the second outer panel and a central portion of the second liner panel is not connected to the second outer panel.

11. The armband of claim 10, further comprising:

a slit defined in the second outer panel and a secondary pocket defined between the second liner panel and the second outer panel, wherein the secondary pocket is bound by the perimeter of the second liner panel that is connected to the second outer panel.

12. The armband of claim 1, further comprising:

a binding at the top edge of the first outer panel of material, wherein the tab on the top edge of the first liner material is stitched to the binding to connect the tab to the inner surface of the first outer panel of material.

13. The armband of claim 1, wherein a width of the tab is less than a width of the remainder of the first liner panel that hangs downward from the tab that stitched to the binding.

14. A method of inserting a device into an armband comprising:

engaging a strap and a fastener to secure the armband about a user's arm;

inserting a device into a pocket of an armband having a first material layer having a first liner panel attached thereto and a second material layer having a second liner panel attached thereto, wherein the first liner panel is composed of a polymer material and comprises a top edge that is upwardly extended within the pocket, and wherein the top edge is connected with the inner surface of the first outer panel and a remainder of the first liner panel hangs free within the pocket, wherein the first liner panel further comprises that the top edge includes a neck and a pair of shoulders that define a tab, and the tab is upwardly extended within the pocket and the tab is connected with the inner surface of the first outer panel; and securing the device within the pocket between the first and the second liner panels.

15. The method of claim 14, wherein the device is a smartphone.

16. The method of claim 14, further comprising:

moving a cover from an open position wherein the cover is behind the second material layer to a closed position wherein the cover is in front of the second material layer and at least a portion of the first material layer.

17. The method of claim 14, further comprising:

removing the device from the pocket; and disengaging the strap and fastener to remove the armband from the user's arm.

18. The method of claim 17, wherein the first and the second liner panels have a coefficient of friction less than 1 and wherein removing the device from the pocket further comprises:

moving the device along at least one of the first and the second liner panels upwards out of the pocket.

19. The method of claim 14, further comprising:

moving the device past the tab on the top edge of the first liner panel.

20. The method of claim 14, further comprising:

stretching the first material layer around edges of the smartphone to provide targeted tension in the armband to securely hold the smartphone at the edges, wherein edges of the first liner panel that free hang in the pocket are adjacent the edges that receive the targeted tension of the first material layer.

* * * * *